United States Patent [19]

Tanaka et al.

[11] 4,321,442

[45] Mar. 23, 1982

[54] SMALL-SIZED SWITCH WITH INDICATOR

[75] Inventors: Yukihisa Tanaka; Shigeo Ohashi, both of Tokyo, Japan

[73] Assignee: Nihon Kaiheiki Kogyo Kabushiki Kaisha, Japan

[21] Appl. No.: 167,187

[22] Filed: Jul. 8, 1980

[30] Foreign Application Priority Data

Oct. 19, 1979 [JP] Japan ..... 54-143994[U]

[51] Int. Cl.[3] ..... H01H 9/16

[52] U.S. Cl. ..... 200/308; 200/296

[58] Field of Search ..... 200/67 G, 295, 296, 200/308, 309, 315, 333, 339; 116/279

[56] References Cited

U.S. PATENT DOCUMENTS

| | | | |
|---|---|---|---|
| Re. 30,546 | 3/1981 | Piber | 200/308 |
| 2,605,374 | 7/1952 | Batcheller | 200/295 |
| 3,250,887 | 5/1966 | Sorenson | 200/308 |
| 3,538,285 | 11/1970 | Orts | 200/308 |
| 3,824,948 | 7/1974 | Faloon | 200/308 |
| 3,885,116 | 5/1975 | Kodaira | 200/308 |
| 3,928,743 | 12/1975 | Ohashi | 200/308 |
| 3,930,135 | 12/1975 | Kodaira | 200/308 |
| 4,024,367 | 5/1977 | Kodaira et al. | 200/308 |
| 4,230,917 | 10/1980 | Osika | 200/339 |
| 4,242,551 | 12/1980 | Sorenson | 200/315 |

FOREIGN PATENT DOCUMENTS

| | | | |
|---|---|---|---|
| 1490542 | 7/1969 | Fed. Rep. of Germany | 200/309 |
| 2260733 | 6/1974 | Fed. Rep. of Germany | 200/308 |

*Primary Examiner*—Stephen Marcus

*Attorney, Agent, or Firm*—Lawrence I. Field

[57] ABSTRACT

An improved small-sized rocker switch with indicator is provided. The switch is constituted by a housing having at least one open end; a main contact disposed in the housing; a cover member attached to the open end of the housing; a movable lever disposed in the housing such that its one end is located in the housing while the other end is projected outwardly from the cover member; a converter provided at one end of the movable lever and adapted for opening and closing the main contact; a switch actuator mounted tiltably on the cover member and having an internal cavity, the switch actuator further having a window through which the internal cavity is observable and a bridge member disposed in the internal cavity and connected to the other end of the movable lever; and a substantially U-shaped plate-like indicate member mounted in the internal cavity of the switch actuator so as to saddle over the bridge member, the indicator member having free ends mounted on the cover member.

12 Claims, 13 Drawing Figures

SMALL-SIZED SWITCH WITH INDICATOR

BACKGROUND OF THE INVENTION

The present invention relates to an improved small-sized switch with an indicator and, more particularly, to an improved small-sized rocker switch with an indicator, having a main contact adapted to be opened and closed by means of an actuator, wherein the indicate function is added merely by attaching a novel indicate member for indicating the state of the switch without requiring any modification of the inside of the switch body itself.

The switch with indicator of the kind described above is disclosed in, for example, the U.S. Pat. No. 3,928,743.

According to this prior art, it is possible to grasp and discriminate the on or off state of the switch quite clearly and distinctively because of a large size of the indicate window. This prior art, however, suffers a disadvantage that, since an actuator and a converter are tiltably attached to respective shafts disposed at an upper and lower parts of the switch housing and adapted cooperatively to tilt in opposite directions to each other with respect to the switch housing, it is necessary to mount two independent shafts vertically spaced from each other, resulting in a larger height of the switch as a whole. This goes quite contrary to the demand for reducing the size of the switch.

To overcome this problem, the U.S. Pat. No. 4,024,367 proposes a new switch. This switch, however, is not suitable for small-sized switch of the type described, because of its too complicated construction including a movable indicate member disposed beneath the actuator and adapted to be moved in the opposite direction to the direction of tilting of the actuator and converter which are coaxially connected to each other.

SUMMARY OF THE INVENTION

Generally speaking, in accordance with the present invention, there is provided a small-sized rocker switch with indicator. The switch comprises a housing having at least one open end; a main contact accomodated in the housing; a cover member attached to the open end of the housing; a movable lever disposed in the housing such that its one end located in the housing while the other end projects of the cover member; a converter disposed at one end of the movable lever and adapted to open and close the main contact; a switch actuator tiltably mounted on the cover member and having an internal cavity, the switch actuator having an window which permits the inspection of the space inside the internal cavity and a bridge member disposed in the internal cavity and connected to the other end of the movable lever; and a substantially U-shaped plate-like indicate member having free ends and disposed in the internal cavity of the switch actuator in such a manner as to saddle over the bridge member, the free ends of the indicate member being releasably fixed to the cover member.

Accordingly, it is a major object of the present invention to provide an improved small-sized switch with indicator.

It is another object of the invention to provide an improved small-sized switch with indicator in which the indicate function for indicating the state of the switch is added simply by attaching an indicate mechanism to an upper part of the switch body without necessitating any substantial change or modification of the inside of the switch body.

It is still another object of the invention to provide an indicate mechanism of a highly simplified construction suitable to be incorporated in a switch.

Other objects and advantageous features of the invention will be apparent or become clear from the following description of the preferred embodiments.

The invention, therefore, is constituted by the following structural features, combination of members and arrangements of parts, which will be described hereinunder through embodiments and the scope of the invention is well defined in the appended claims.

BRIEF DESCRIPTION OF THE DRAWINGS

In order to fully understand the invention, a reference shall be made to the following description together with the attached drawings in which.

DESCRIPTION OF THE PREFERRED EMBODIMENT

Figure 1:
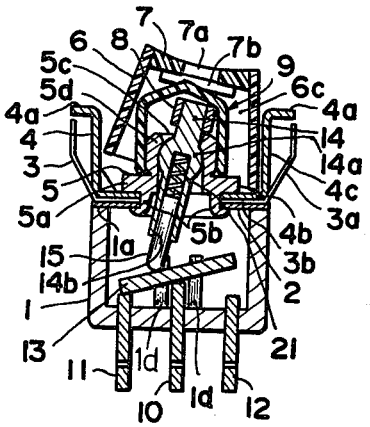
FIG. 1 is a schematic sectional view of a small-sized switch with indicator, constructed in accordance with a preferred embodiment of the invention.
Figure 2:
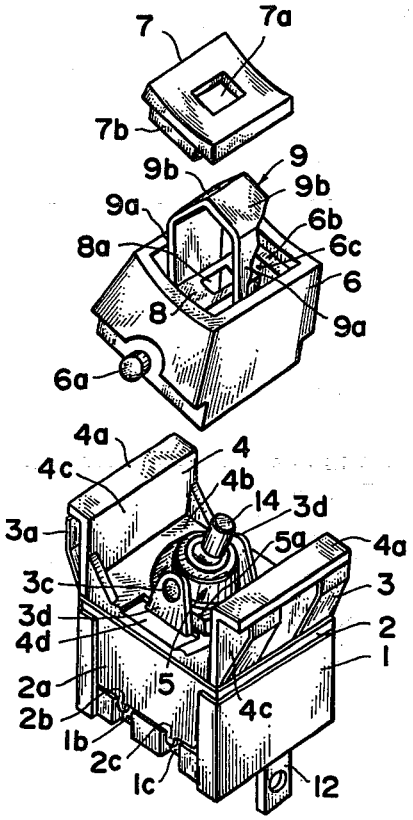
FIG. 2 is an exploded perspective view of an essential part of a small-sized switch with indicator constructed in accordance with the preferred embodiment of the invention.

Referring to FIGS. 1 and 2 which are a sectional view of the whole part and an exploded perspective view of an essential part of a switch in accordance with the invention, respectively, a reference numeral 1 denotes a housing having an open end surface 1*a* and adapted to accomodate a switch body. To the open end surface 1*a*, attached is a cover member materially covering the housing 1 and constituted by a closure plate 2, cover 4, a resilient plate 3 interposed between the closure plate 2 and the cover 4, and a sleeve 5 fitted to the closure plate 2 and the cover 4.

The closure plate 2 has tabs 2*a* (See FIG. 2) suspended from the front and rear ends thereof. These tabs 2*a* have claws 2*b*, 2*c* at both sides of lower ends thereof adapted to be bent and caulked to corresponding recesses 1*b*, 1*c* of the housing 1, thereby to fix the closure plate 2 to the housing 1. The resilient plate 3 is constituted by a bottom panel 3*b* and resilient tab 3*a* which is bent and extended upwardly from one end at the outer side of the bottom panel 3*b*. The cover 4 is constituted by a bottom panel 4*b* having an aperture 4*d* formed therein, upright tabs 4*c* extending upwardly from both ends of the bottom panel 4*b* at a right angle to the latter and flanges 4*a* which extend outwardly from the upper ends of the upright tabs. The resilient tabs 3*a* and the flanges 4*a* are provided to make it possible to attach the switch to the panel at one touch. Namely, the switch can be attached tightly by one touch to the panel, because the upper ends of both resilient tabs 3*a* act to push upward the peripheries of an opening 20*a* of the panel 20 as the switch is inserted from the outer side of the panel into the opening 20*a*.

The sleeve 5 has a base portion 5*a* which is mounted on the bottom panel 4*b* of the cover 4. A projection 5*b* extends downwardly from the base portion 5*a* through the openings formed in the bottom panel 4*b* of the cover 4, bottom panel 3*b* of the resilient plate 3 and the closure plate 2 and is bent and caulked at its lower end. These openings are neglected from the drawings. Thus, the sleeve 5 is fixed to the closure plate 2 together with the closure member 4 and the resilient plate 3.

As shown in FIG. 1, a movable lever 14 is diposed in the housing 1 and projects out of the upper end surface 5*c* of the sleeve 5. The movable lever 14 is provided at its substantially mid portion with a roller portion 14*a* which is biased by a later-mentioned compression spring 21 toward a roller receiving portion 5*d* formed at an upper part of the inner surface of the sleeve 5, so that the movable lever 14 can tilt to the left and right around a fulcrum constituted by the roller receiving portion 5*d*.

The movable lever 14 is provided at its lower portion with a notch 14*b* which cuts deeply from the lower end in the upward direction. A converter 15 is accomodated in this notch 14 through the medium of a compression spring 21.

As will be mentioned later, the converter 15 is resiliently contacted by a movable contact piece 13 so as to open and close the main contact. Namely, as shown in FIG 1, the movable contact piece 13 is supported by a pair of supporting walls 1*d*, 1*d* projecting into the housing 1, and is contacted at the center of the lower face thereof by a terminal 10 which extends through the bottom panel of the housing 1. The movable contact piece 13 is tiltably supported for free tilting movement around a fulcrum constituted by the terminal 10, to make selective contact with a stationary contact/terminal 11 or 12 which extends through the bottom panel of the housing 1 as in the case of the terminal 10, and is pressed at its upper face by the converter 15 which is resiliently urged by the compression spring 21. The upward reaction force applied by the compression spring 21 is received by the roller receiving portion 5*d* on the inner surface of the sleeve 5, through the medium of the roller portion 14*a* of the movable lever 14.

Figure 3:
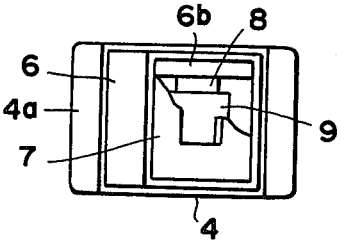
FIG. 3 is a top plan view of the switch of FIG. 1 with a portion broken away.

A switch actuator 6 is interposed between the left and right upright tabs 4*c*, 4*c*. Namely, a short shaft 6*a* (See FIG. 2) is formed at the central part of the lower portion of the front and rear walls of the switch actuator 6, while front and rear bearing tabs 3*d*, 3*d* are formed to protrude from the bottom panel 3*b* of the resilient plate 8 through respective openings 4*d* formed in the bottom panel 4*b* of the cover 4. Each of the bearing tabs 3*d*, 3*d* is provided at its upper portion with bearing bore 3*c* receiving the aforementioned shaft 6*a*. The upper and lower sides of the switch actuator 6 are opened, and an upper lid 7 is fitted to the opened upper side of the switch actuator 6. Short legs 7*b* are formed to extend downwardly from portions of the lower face of the lid 7 slightly apart from the front and rear extremities of the lid 7. As will be seen from FIGS. 2 and 3, upwardly directed steps 6*b* are formed on the inner sides of the front and rear end parts of the body of the switch actuator 6 at portions slightly lowered from the top end of the switch actuator 6. The lower sides of the front and rear ends of the upper lid 7 are placed on the above-mentioned steps 6*b* and legs 7*b* are pressed at a suitable resiliency to the vertical walls below the steps 6*b*.

A window 7*a* is formed at the mid portion of the upper lid 7 between the right and left ends of the latter. This window 7*a* may be left in the form of an aperture or a suitable transparent member may be fitted to the window 7*a*. Alternatively, the whole part of the upper lid 7 is made of a transparent plastic material and the portions other than the window 7*a* is colored at either the outer or inner surfaces or covered with an opaque member.

The switch actuator 6 is materially hollow and is provided with an internal cavity 6*c*. A bridge member 8 in the form of an angular rod is extended between the inner faces of the front and rear walls of the switch actuator 6. The bridge member 8 may be formed integrally with the switch actuator 6 or may be formed separately and rigidly connected to the latter. An aperture 8*a* is formed substantially at the mid portion of the bridge member 8 and receives the upper end of the movable lever 14 (as shown in FIG. 1) so that the switch actuator 6 and the movable lever 14 are connected integrally with each other to make a tilting motion to the left and right as a unit with each other. Therefore, in this embodiment, the rotary shaft of the movable lever 14 and the rotary shaft of the switch actuator 6 are coaxial with each other. The upper part of the aperture 8*a* may be closed suitably.

Figure 7A:
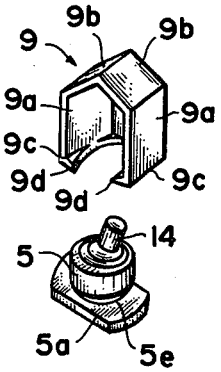
FIG. 7*a* is a perspective view of an example of the construction for fixing the indicate member of a small-sized switch with indicator constructed in accordance with the preferred embodiment of the invention.
Figure 7B:
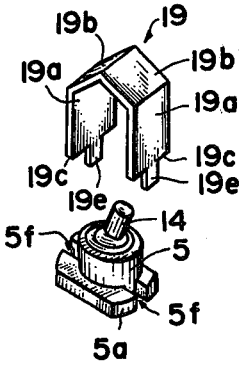
FIG. 7*b* is a perspective view of an another example of the construction for fixing the indicate member of a small-sized switch with indicator constructed in accordance with the preferred embodiment of the invention.

A substantially U-shaped plate-like indicate member 9 is disposed in the internal cavity 6*c* of the switch actuator 6 and is placed to saddle over the bridge member 8 from the upper side of the latter. The indicate member 9 is constituted by a pair of upright portions 9*a*, 9*a* and indicate portions 9*b*, 9*b* interconnecting these upright portions 9*a*, 9*a* are bent in the form of a mountain as illustrated. Thus, the indicate member 9 is opened at its front and rear sides and is provided at the base portions 9*c*, 9*c* constituting the free ends of the upright portions 9*a*, 9*a* with engaging claws 9*d*, 9*d* as shown in FIG. 7*a*. These claws 9*d*, 9*d* are resiliently engaged by corresponding recesses 5*e* formed in the base plate 5*a* of the sleeve 5. FIG. 7*b* shows another example of the construction for fixing the indicate member, in which claws 19*e*, 19*e* are formed on the base ends 19*c*, 19*c* of the upright portions 19*a*, 19*a*, for engagement with corresponding recesses 5*f*, 5*f* formed in the base plate 5*a* of the sleeve 5 thereby to fix the indicate member 19 to the sleeve 5. The indicate member 9 (19) is preferably made of a resilient material such as plastic.

As still another measure for fixing the indicate member which is adopted when there is a sufficient margin of space between the base plate 5*a* of the sleeve 5 and the upright tabs 4*c*, 4*c* of the cover 4, the free ends of the indicate member are placed in these spaces and are retained by suitable holes (not shown) formed at these portions.

The indicate member 9 (19) is provided on its upper face with a left and right indicate portions which bear suitable signs representing the opened and closed states of the switch, respectively. For instance, the left half part is colored with white, while the right half part is colored with red. Also, suitable signs such as characters ON and OFF may be used. The state of the switch can be confirmed even in the dark, if these signs are made by a fluoroscent paint.

For assembling the switch shown in FIG. 1, the shaft 6*a* of the switch actuator 6 with the lid 7 not attached is fitted to the bearing bores 3*c* by making use of the resiliency of the upright tabs 3*d* constituting the bearings. At the same time, the bridge member 8 formed unitarily with the switch actuator 6 is fitted to the end of the movable lever 14. Subsequently, the indicate member 9 is forcibly inserted from the upper side of the switch actuator 6 to saddle over the bridge member 8 and the lower end of the indicate member 9 is secured to the sleeve 5. Thereafter, the upper lid 7 is fitted to the upper side of the switch actuator 6.

In the state shown in FIG. 1, the signal, e.g. red color, on the right half part of the indicate portion 9*b* on the upper face of the indicate member 9 is observed through the window 7*a*. Then, as the left part of the upper face of the switch actuator 6 is depressed, the switch actuator 6 rotates around the axis of the shaft 6*a* (See FIG. 2) in the counter-clockwise direction so that the bridge member 8 is moved to the left to cause a counter-clockwise rotation of the movable lever 14. The indicate member 9, however, remains unmoved irrespective of this operation. Then, as the switch actuator 9 has reached the end of the counter-clockwise rotation, the window 7*a* is positioned above the left half part of the indicate portion 9*b* on the upper face of the indicate member 9 where the signal, e.g. the white color is beared. When the movable lever 14 takes the position shown in FIG. 1, the central terminal 10 is connected to the left-side terminal 11. However, as the lever 14 is rotated to the opposite position, the central terminal 10 is connected to the right-side terminal 12. This state can be discriminated and confirmed by the sign on the indicate member 9 observed through the window 7*a*.

Figure 5A:
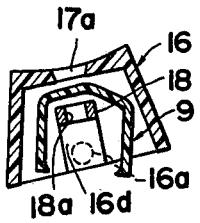
FIG. 5*a* is a sectional view of an example of an switch actuator incorporated in the small-sized switch with indicator constructed in accordance with the invention.

FIG. 5*a* shows a modification of the switch actuator in which the body of the switch actuator and the upper lid are formed not separately but integrally with each other. In this embodiment, the switch actuator 16 and the bridge member 18 are connected detachably to each other so that the indicate member 9 may be interposed therebetween. More specifically, shallow grooves 16*d* are formed in the inner surfaces of the front and rear walls of the switch actuator 16 to extend upwardly from the lower end for guiding and facilitating the attaching and detaching of the bridge member 18 to and from the switch actuator 16. Namely, the front and rear ends of the bridge member 18 are slided in these grooves when it is attached and detached to and from the switch actuator 16. For assembling the switch of this embodiment, after fitting the indicate member 9 to the switch actuator 16, the bridge member 18 is fitted to the grooves 16*d* of the switch actuator 16, and thereafter, the movable lever 14 (see FIG. 2) is fitted to the aperture 18*a* of the bridge member 18 and, at the same time, the shaft 16*a* of the switch actuator 16 are inserted into the bearing bores 3*c* (See FIG. 2). Alternatively, at first the bridge member 18 solely is fitted to the movable lever 14 (See FIG. 2) and the indicate member 9 is inserted and fixed to saddle over the latter. Thereafter, the switch actuator 16 is attached such that its grooves 16*d* receive the bridge member 18 with its shaft 16*a* fitted to the bearing bores 3*c* (See FIG. 2). The window 17*a* formed in the center of the upper face of the switch actuator 16 performs the same function as the window 7*a* of the first embodiment. FIG. 5*a* shows the switch actuator 16 turned to the opposite side to that shown in FIG. 1.

Figure 5B:
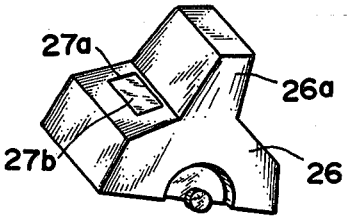
FIG. 5*b* is a perspective view of another example of the switch actuator incorporated in the small-sized switch with indicator constructed in accordance with the preferred embodiment of the invention.

FIG. 5*b* shows a modification of the switch actuator in which the window 27*a* is formed at a position offset from the center of the switch actuator 26 having a manipulation knob 26*a* and is covered with a transparent member 27*b*.

Figure 6:
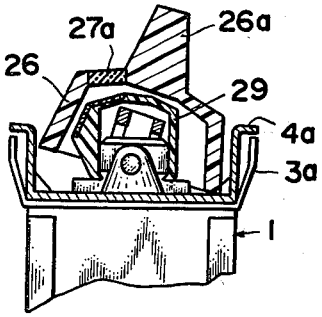
FIG. 6 is a partial sectional view of a small-sized switch with indicator incorporating, in combination, the switch actuator shown in FIG. 5*b* and an indicate member shown in FIG. 8*a;*
Figure 8A:
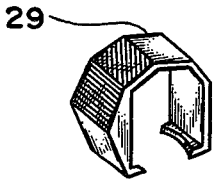
FIG. 8*a* is a perspective view of another example of the indicate member incorporated in the small-sized switch with indicator constructed in accordance with the preferred embodiment of the invention.
Figure 8B:
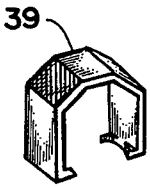
FIG. 8*b* is a perspective view of still another example of the small-sized switch with indicator constructed in accordance with the preferred embodiment of the invention.

FIG. 6 shows in section a small-sized switch with indicator, with a part of the latter omitted, incorporating, in combination, the switch actuator 26 shown in FIG. 5*b* and an indicate member 29 shown in FIG. 8*a*. In this embodiment, it is possible to use the indicate member 39 as shown in FIG. 8*b*.

Figure 5C:
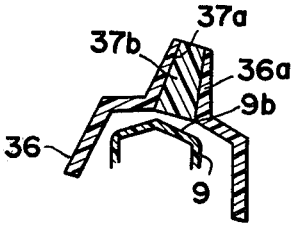
FIG. 5*c* is a sectional view of still another example of the switch actuator incorporated in the small-sized switch with indicator constructed in accordance with the preferred embodiment of the invention.

FIG. 5*c* shows another modification of the switch actuator in which the window 37*a* is formed in the manipulation knob 36*a* formed at the center of the switch actuator 36 and a lens 37*b* is fitted to the window 37*a* which provides a view of the indicate portion 9*b* of the indicate member 9 at a larger scale from the outside.

Figure 9:
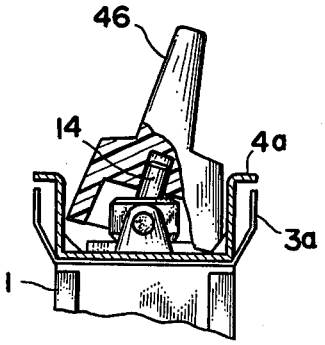
FIG. 9 is a partly sectioned front elevational view of a small-sized switch without an indicate mechanism, constructed by re-assembling the small-sized switch with indicator in accordance with the preferred embodiment of the invention.

FIG. 9 is an illustration for showing the fact that the switch shown in FIG. 1 can be assembled easily also as an ordinary switch without indicator. In the switch shown in FIG. 9, the movable lever 14 projects upward from the sleeve 5 as in the switch shown in FIG. 1. In this switch, however, the switch actuator 6, the upper lid 7 and the indicate member 9 as in FIG. 1 ae omitted and a switch actuator 46 is directly fitted at its recess formed in the lower face thereof to the end of the movable lever 14. This switch is an ordinary switch having no indicator.

Figure 4:
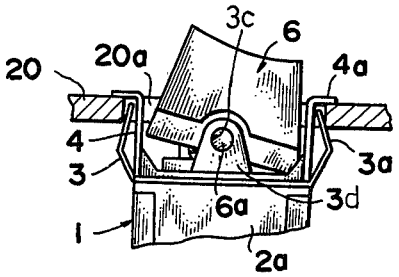
FIG. 4 is a front elevational view of an essential part of the small-sized switch with indicator constructed in accordance with the preferred embodiment of the invention, in the state after attaching to a panel surface.

The embodiments shown in the drawings are of one-touch attaching type making use of a resilient fit between resilient members 3*a* and the flanges 4*a*. This arrangement, however, is not essential. For instance, it is possible to attach the switch to the panel by means of screws which are screwed into the panel 20 (See FIG. 4) through screw holes formed in the flanges 4*a* shown in FIG. 1. In this case, the flanges 4*a* have to be formed to have a length somewhat greater than those shown in FIG. 1.

As has been described, according to the present invention, it is possible to obtain a small-sized rocker switch with indicator, merely by adding a simple mechanism to the switch actuator of the switch without necessitating any substantial change or modification of the inside of the switch body. Therefore, the size of the switch is substantially equal to the existing switch and the cost of the production is not so raised.

In addition, the switch with indicator can easily be modified as desired into a switch having no indicator so that it is not necessary to design and produce both types of switches, which advantageously reduces the burden of stock of the switch.

Furthermore, according to the invention, it is possible to obtain an improved small-sized switch with indicator having an indicate mechanism of a simple construction.

Although the invention has been described through its preferred embodiments, the described embodiments are only for illustrative purpose and are not exclusive. Rather, various changes and modifications may be imparted to the described embodiments without departing from the spirit and scope of the invention.

Similarly, the claims appended hereto are intended to cover all of the generic and specific features of the invention, but the scope of the invention defined by these claims should be interpreted without sticking to the terms used in these claims.

What is claimed is:

1. A small-sized switch with indicator comprising:

a housing having at least one open end;

a main contact accomodated in said housing;

a cover member attached to the open end of said housing;

a movable lever disposed in said housing, one end of said movable lever being located in said housing while the other end projecting out of said cover member;

a converter provided at one end of said movable lever and adapted for opening and closing said main contact;

a switch actuator tiltably mounted on said cover member and having an internal cavity, said switch actuator further having a window through which a space inside said internal cavity is observed and a bridge member disposed in said internal cavity, said bridge member being connected to the other end of said movable lever; and a substantially U-shaped plate-like indicate member mounted in said internal cavity of said switch actuator so as to saddle over said bridge member, free ends of said U-shaped plate-like indicate member being releasably fixed to said cover member.

2. A small-sized switch with indicator as claimed in claim 1, wherein the end of said movable lever is fitted to an aperture formed substantially at the mid point of said bridge member.

3. A small-sized switch with indicator as claimed in claim 1, wherein said indicate member has an indicate portion bearing at least two different signs one of which is observeable from the outside through said window.

4. A small-sized switch with indicator as claimed in claim 3, wherein said indicate portion of said indicate member has a mountain-shaped cross-section.

5. A small-sized switch with indicator as claimed in claim 3, wherein said switch actuator is constituted by an upper lid and a switch actuator body, said window being formed substantially at the center of said upper lid, said upper lid and said switch actuator body being detachably connected to each other.

6. A small-sized switch with indicator as claimed in claim 3, wherein said window is formed on a manipulation knob formed at the central portion of the outer surface of said switch actuator, said window being covered with a lens so that said indicate portion can be observed from the outside through said lens at a certain magnification.

7. A small-sized switch with indicator as claimed in claim 3, wherein said window is formed at a position offset from the center of said switch actuator and is covered with a transparent member.

8. A small-sized switch with indicator as claimed in claim 1, wherein said cover member includes a closure plate attached to the open end of said housing, a cover, a resilient plate interposed between said closure plate and said cover and a sleeve fitted to said closure plate and said cover and accomodating said movable lever.

9. A small-sized switch with indicator as claimed in claim 8, wherein said indicate member is made of a resilient member and said free ends are detachably engaged by said sleeve.

10. A small-sized switch with indicator as claimed in claim 8, wherein said switch actuator is supported pivotally by bearing bores formed in upright tabs of said resilient plate so as to be able to tilt around a fulcrum constituted by said bearing bores.

11. In a rocker switch having a housing, a main contact, a switch actuator tiltably mounted on said housing and having an internal cavity and a window through which said internal cavity is observeable from the exterior of said switch, a converter including a manipulation lever tiltably mounted in said housing for converting said main contact, and a position indicating assembly disposed in the vicinity of said window and provided with an indicating surface, the improvement which comprises a position indicating sub-assembly including:

a bridge member disposed in said internal cavity of said switch actuator and connected to said switch actuator and connected also to one end of said manipulation lever; and a substantially U-shaped plate-like indicating member disposed in said internal cavity of said switch actuator so as to saddle over said bridge member, said indicating member having free ends releasably fixed to a stationary portion of said housing.

12. A position indicating sub-assembly as claimed in claim 11, wherein a rotational axis of said switch actuator and a rotational axis of said converter are disposed coaxially with each other.

* * * * *